US005958327A

United States Patent [19]

Beven et al.

[11] Patent Number: 5,958,327

[45] Date of Patent: Sep. 28, 1999

[54] TOBACCO SMOKE FILTRATION MATERIAL

[75] Inventors: John Lawson Beven, Thurleston; Paul David Case; Martin Coleman, both of Southampton; Colin Campbell Greig, Redlynch, all of United Kingdom

[73] Assignee: British-American Tobacco Company Limited, Middlesex, United Kingdom

[21] Appl. No.: 08/727,609

[22] PCT Filed: Apr. 13, 1995

[86] PCT No.: PCT/GB95/00863

§ 371 Date: Oct. 16, 1996

§ 102(e) Date: Oct. 16, 1996

[87] PCT Pub. No.: WO95/28097

PCT Pub. Date: Oct. 26, 1995

[30] Foreign Application Priority Data

Apr. 19, 1994 [GB] United Kingdom ..... 9407715

[51] Int. Cl.[6] ..... A24D 3/02

[52] U.S. Cl. ..... 264/571; 264/101; 264/148; 264/157; 425/296; 425/388; 425/392

[58] Field of Search ..... 226/170, 171, 226/172; 264/53, 140, 148, 157, 101, 571; 425/388, 392, 296

[56] References Cited

U.S. PATENT DOCUMENTS

| | | | |
|---|---|---|---|
| 3,915,075 | 10/1975 | Luke et al. | 226/171 |
| 4,149,546 | 4/1979 | Luke et al. | 425/392 |
| 4,436,517 | 3/1984 | Lebet | 425/392 |
| 4,452,752 | 6/1984 | Harder et al. | 264/571 |
| 4,576,769 | 3/1986 | Hargett, Jr. | 425/392 |
| 4,625,737 | 12/1986 | Keritsis et al. | 131/355 |
| 4,958,055 | 9/1990 | Keller et al. | 426/241 |
| 5,000,891 | 3/1991 | Green | 264/53 |
| 5,360,281 | 11/1994 | Kamen et al. | 401/96 |
| 5,523,036 | 6/1996 | Luke et al. | 264/45.3 |

FOREIGN PATENT DOCUMENTS 2 205 102 11/1988 United Kingdom .

*Primary Examiner*—Allan R. Kuhns

*Attorney, Agent, or Firm*—Kane, Dalsimer, Sullivan, Kurucz, Levy, Eisele and Richard, LLP

[57] ABSTRACT

The invention relates to a method and apparatus for the downstream handling of water soluble polysaccharide-containing extruded tobacco smoke filtration material. During conveying of the extrudate from the extruder die of an extruder to a cutter, the extrudate is heated, shaped, and cooled to provide tobacco smoke filtration material of desired dimensions and physical characteristics.

26 Claims, 1 Drawing Sheet

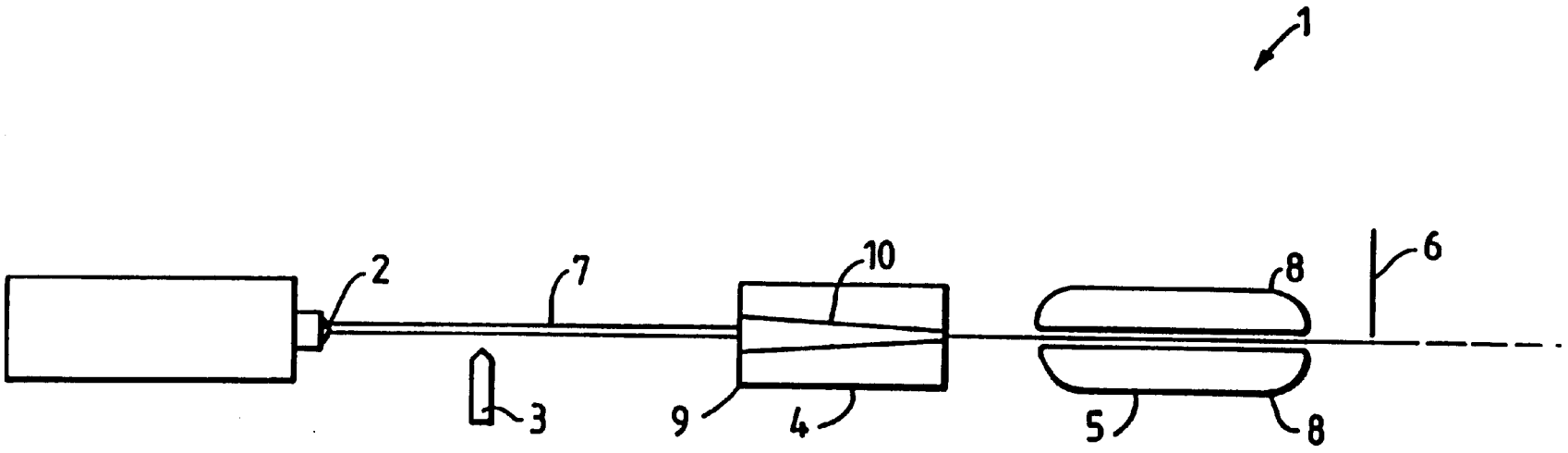
1
2
3
4
5
6
7
8
8
9
10

TOBACCO SMOKE FILTRATION MATERIAL

This invention relates to a method and apparatus for the downstream handling of an extruded tobacco smoke filtration material.

As used herein, the term 'downstream handling' means the treatment, or handling, of an extruded material, or extrudate, as it emerges from the extruder die of an extruder.

Extrusion techniques in the food and plastics industries are well known. In the food industry, often the downstream handling of extruded products generally consists of cutting the extrudate almost immediately after extrusion and then subjecting the cut extrudate to a further treatment, such as frying, often to cause further expansion. Where extruded food products are not cut immediately after extrusion, e.g. spaghetti, the extrudate is usually extruded at about the final diameter thereof. Food products also tend to have less of a requirement for a particular dimension or shape when they are extruded. In the plastics industry, extruded products such as plastic tubes, etc., are normally extruded at the size of the extruder die and only require cooling to consolidate the shape and size of the article once extruded. Cooling in this instance is normally achieved by passing the extruded article of predetermined size through a water bath, for example.

In the tobacco industry, for filtration materials we have the requirement to foam or expand an extruded product upon extrusion from the die so that tobacco smoke can be drawn through the filtration material to effectively reduce certain particulate matter smoke components. We also have the requirement to provide a rod of filtration material which has a consistent circumference dimension and pressure drop characteristic. These features are specific to the requirement of the tobacco industry as far as extruded tobacco smoke filtration materials are concerned. These requirements place burdens on the extrusion technologist when making tobacco smoke filtration material which are not seen in the food or plastics extrusion industry.

This invention has as an object the provision of a method for producing a consistent sized or shaped length of filtration material from which to produce tobacco smoke filter elements.

This invention has as a further object the provision of a degradable tobacco smoke filtration material. As used herein the term degradable means that all water soluble or water dispersible components are dissolved or dispersed and the non-water soluble or non-water dispersible components do not form a fused or melted amalgamation upon addition of water. There is a change in physical form, the strength and shape of the extrudate being lost due to the effects of water and/or sunlight.

The present invention provides a process of downstream handling of a water-soluble polysaccharide-containing extruded tobacco smoke filtration material to produce tobacco smoke filter elements, the method comprising the steps of conveying extrudate from an extruder die of an extruder to a cutter, during the transporting of the extrudate removing excess moisture therefrom, if required, providing the extrudate at a temperature suitable for shaping the extrudate, shaping the extrudate to substantially the required circumferential dimension, cooling the shaped extrudate to a predetermined cutting temperature, and cutting the shaped extrudate into filter element lengths, multiples thereof or lengths as otherwise desired.

The present invention further provides downstream handling apparatus particularly adapted for water-soluble polysaccharide-containing extruded tobacco smoke filtration material, the apparatus comprising extrudate conveying means operable to travel at a speed relative to the extrusion speed of the extrudate as the extrudate exits the extruder die, means operable to heat the extrudate to remove excess moisture from the extrudate, if required, shaping means to shape the extrudate, cooling means to cool the extrudate and a cutter to cut the shaped extrudate into tobacco smoke filter element lengths, multiples thereof or lengths as otherwise desired.

The water-soluble polysaccharide-containing extrudate may comprise 0–90% plastics material or inorganic material, 5–100% water-soluble polysaccharide expansion medium and 0–50% binder. Alternatively, the water-soluble polysaccharide-containing extrudate may have any composition as described in European Patent Application No.94301642.8. The water-soluble polysaccharide material may be starch, modified starch, cellulosic binder or a modified cellulosic binder.

Preferably, the removal of excess moisture from the extrudate is achieved by a heating step. A heating step may not be required if the extrudate is extruded using a technique which effectively dries, i.e. reduces the moisture content of, the extrusion mixture before extrusion occurs, e.g. a vacuum venting extruder. Alternatively, the extrudate may be extruded at a moisture content which does not require a heating step in the downstream handling stage.

The extrudate conveying means serves to haul off the extrudate from the extruder die of an extruder and may be operable to run at a speed which is the same as the extrusion speed of the extrudate from the extruder or at a speed which is greater than the extrusion speed of the extrudate from the extruder. The speed of operation of the conveying means is preferably fixed, but may be varied for control purposes. Advantageously the speed of operation of the conveying means is linked with an extrudate physical measurement system, such as for example, an extrudate diameter measurement system. A suitable feedback system could include a laser micrometer.

The extrudate conveying means may comprise one or more conveying means to convey the extrudate away from the extruder. Advantageously, the extrudate conveying means comprises an endless, for example, flexible belt, suitably provided with grooves of the same or smaller dimension as the shaped extrudate leaving the shaping means. Alternatively, the extrudate conveying means may be a perforated belt, the perforations of which allow hot air from the heating means or cool air from the cooling means to heat or cool the extrudate lying on the perforated belt. The perforated belt may be a mesh. In a further alternative, the extrudate conveying means may comprise a series of rollers. Yet a further alternative for the extrudate conveying means is an air bearing means, such as for example, those devices known as air knives.

In all of the above cases the extrudate conveying means is preferably located downstream of the shaping means. The or an extrudate conveying means may be located, in addition, upstream of the shaping means. The extrudate conveying means may not necessarily be located before some cooling of the extrudate takes place.

The conveying means, if it is a flexible belt, may also be the shaping means for shaping the extrudate to substantially the required circumferential dimension.

Preferably, the means to remove excess moisture from the extrudate comprises heating means. Advantageously the heating means utilises hot air blowers, for example, the air for the heating means being heated to a temperature preferably within the range of 85°–300° C., suitably within the range of 85°–130° C., and is preferably at least 100° C. Suitably the hot air may be directed to flow counter-, co- or cross-directionally to the direction of the conveyed extrudate. In an alternative, microwave, infra-red or radio-frequency heating may be utilised to remove excess moisture from the extrudate at an appropriate magnitude. A further alternative heating means is a thermal jacket disposed to circumscribe the extrudate. The heating means may be the first piece of equipment encountered by the extrudate, even though the extrudate may already be under the effect of haul off conditions.

The shaping means may advantageously comprise a metal block with an orifice tapering to the required circumferential dimension. Alternatively the shaping means may comprise a garniture to shape and size the extrudate with a flexible band. In a further alternative, the shaping means may comprise one or more temperature controlled grooved rollers, the grooves at one end of the roller axis being of a radius which decreases towards the other end of the roller axis. Twin co-operating grooved rollers providing a rotary sizing die may also be used. In yet a further alternative, the shaping means may be a vacuum forming device. Extrudate extruded at a diameter less than desired may be passed through a vacuum forming device and be expanded by the vacuum to the desired size. Some drying of the extrudate may occur simultaneously or slightly thereafter.

The shaping means may also advantageously incorporate cooling means, such as air or water circulation. There may also be a section of the shaping means which acts as the cooling means so that the extrudate when it exits the shaping means is at a temperature at which it is ready to be cut.

The cooling means suitably comprises a supply of cold or ambient air, such as a cold air blower, or means for passing the extrudate over a cooled surface, e.g. a cooling jacket or shaping die, which may be water cooled, refrigerant cooled or Peltier cooled.

The cutter may be a rotary cutter, a reciprocating cutter, a cylindrical cutter, a nip cutter or a laser cutter or cutting means as used in conventional cigarette and filter production machinery. The shaped extrudate may be cut into lengths of, say 1 m, and fed to a number of cutters.

The extruder may advantageously be configured with a vacuum venting system associated therewith. Vacuum venting may be used to control the extrudate moisture content exit the die and may preclude the need for removal of excess moisture by a heating step. Means is suitably still provided to ensure that the extrudate remains at a temperature at which it is pliable prior to entering the shaping means.

The temperature of the extrudate at the exit die is preferably within the range of 90–200° C., and is preferably within the range of 100°0 C. to 150° C. In the heating stage of the extrudate, the extrudate temperature is preferably within the range of 50–200° C., and suitably within the range of 80°–100° C., whereat the extrudate is a flexible, pliable material. Preferably the heating air is hotter than the extruded material in order to remove moisture therefrom and is preferably at least 10°–50 C., suitably 10°–30° C., hotter than the extrudate temperature. The temperature of the external surface of the extrudate as it enters the shaping means is within the range of 50–200° C., suitably 80°–100° C., and may be about 100° C. The temperature of the external surface of the extrudate as it exits the shaping means may be as low as about 40° C., if the extrudate only undergoes some cooling from a water-cooled shaping means. The temperature of the external surface of the extrudate may be about 30° C. if the extrudate is shaped and cooled to the predetermined cutting temperature in one unit.

In the alternative, the shaping means may have a controlled temperature gradient along the shaping die, or tapering orifice, in the shaping means. The temperature gradient is advantageously high at the shaping end, or tapering end, of the shaping means and gradually decreases towards the downstream end.

Preferably the predetermined cutting temperature is less than 40° C. and is more preferably less than 30° C., whereby the shaped extruded tobacco smoke filtration material retains its shape, or circumferential dimension, and the physical characteristics, i.e. pressure drop, are substantially unaltered.

The extrudate conveying means may run at a speed in a range of 5–600 m/min. The speed of the conveying means will be determined appropriate to the output required of the extruder. The physical characteristics of the extrudate vary with the variation in haul off speed above the extrusion speed of the extrudate from the extruder die.

The cut lengths of extruded tobacco smoke filtration material may be fed to a hopper for supply to a filter tipping machine.

The extruder die may comprise a plurality of dies, which may consequently increase the throughput of the extruder.

BRIEF DESCRIPTION OF THE FIGURE

In order that the invention is easily understood and readily carried into effect, reference will now be made to the accompanying diagrammatic figure which shows downstream handling apparatus according to the invention.

DETAILED DESCRIPTION OF THE INVENTION

The figure shows an extruder and downstream handling apparatus 1 particularly suited for starch-containing tobacco smoke filtration material to produce tobacco smoke filter elements. Downstream of an extruder die 2 the apparatus 1 comprises heating means 3, shaping means 4, extrudate conveying means 5 and cutter 6. The heating means is a hot air blower supplying hot air at about 100° C. to drive off excess moisture from the extrudate 7. Extrudate 7 extruded from a BC21 Clextral extruder comprises a mixture of 65% cellulose acetate flake, 24% maize starch and 11% hydroxypropylcellulose. A 25% solution of glycerol in water was fed to the barrel at 1.14 l/hr. The feed rate through the barrel was 8.86 kg/hr. The extruder die 2 is circular and 6 mm in diameter and the exit die temperature was 115° C. The temperature profile along the barrel was 65° C., 85° C. and 115° C. at the final barrel section.

The conveying means 5 comprises a co-operating pair of grooved belts 8. The groove radius together formed a diameter of nominally 8 mm. The grooved belts 8 are thus operable to draw the extrudate 7 away from the extruder die, or haul off the extrudate, at any chosen speed. The conveying means 5 was run at 15 m/min and may be driven at any controlled speed by a variable speed motor. The speed of the conveying means can be varied as required, depending on the desired product characteristics. The variation in speed may be controlled by a feedback system recording, for example, a physical characteristic of the extrudate. Some stretching of the extrudate 7 may occur after the shaping step.

For the conditions available the conveying means was advantageously run at a speed of 10–20 m/min. A much higher conveying means speed may be utilised, depending on the extruder used, the throughput required and the physical characteristics required of the extrudate.

In this embodiment the shaping means 4 comprises a water cooled metal block 9 with a tapering orifice 10 which tapers down to an orifice diameter of nominally 8 mm. The temperature of the external surface of the extrudate 7 as it enters the shaping means 4 is about 100° C., at which temperature the extrudate is still flexible and pliable. At exit from the shaping means 4 the extrudate external surface temperature is about 60° C. We have found that the extrudate 7 requires cooling to a predetermined cutting temperature before cutting can occur to produce rod lengths of consistent physical characteristics. The predetermined cutting temperature is about 30° C. throughout the extrudate body for the recipe in this embodiment.

The shaped cut extrudate is then fed, usually in multiples of filter element length, to a filter tipping machine, possibly via a storage hopper (not shown).

In one alternative embodiment, the conveying means may comprise a series of rollers. Sets of rollers may be arranged upstream and downstream of the heating means and downstream of the shaping means so that the extrudate is supported throughout the downstream handling stages. The rollers of the conveying means could be heated or cooled as desired, according to their location along the handling process.

EXAMPLE 1

In order to ascertain the effect of the haul off speed of the extrudate conveying means on the physical characteristics of the extrudate, three runs were made using the apparatus described in the first embodiment. The same extruder conditions and the same formulation were used, with the exception that the glycerol feed rate was 1.08 l/hr, for a 25% by weight solution of glycerol in water, and the extruder die size was 5.5 mm in diameter. Table 1 below gives details of the results.

TABLE 1

| Run number | 20/1/94/01 | 20/1/94/02 | 20/1/94/03 |
|---|---|---|---|
| Haul off speed (m/min) | 12.9 | 15.5 | 11.3 |
| Back pressure (bar) | 7 | 7 | 8 |
| Throughput (g/min) | 159 | 155 | 156 |
| Extrudate moisture content (%) | 8.44 | 7.95 | 8.36 |
| Extrudate glycerol content (% dwb) | 4.47 | 4.58 | 4.32 |
| Weight (mg/108 mm rod) | 1420 | 1180 | 1720 |
| Circumference (mm) | 25.60 | 25.59 | 27.45 |
| Pressure drop (mm WG/108 mm rod) | 594 | 435 | 689 |
| Firmness (%) | 89.89 | 87.96 | 92.33 |
| Density (mg/cc) | 252 | 210 | 266 |

dwb = dry weight basis

The water-soluble polysaccharide-containing extruded tobacco smoke filtration material produced according to the invention is a foamed open cellular structure which allows draw of smoke therealong, which filters the particulate matter of the smoke and which is degradable under the natural weather conditions of the environment.

When the process is run with an extruder die having two die holes, the extrudate obtained from each die was substantially similar.

We claim:

1. A process of downstream handling of a water-soluble polysaccharide-containing degradable extruded tobacco smoke filtration material to produce tobacco smoke filter elements, the method comprising the steps of continuously conveying the extrudate from an extruder die of an extruder to a cutter, during the transporting of the extrudate removing excess water, if required, providing the extrudate: at a temperature suitable for shaping the extrudate, shaping the extrudate by passing the extrudate through a vacuum forming device to expand said extrudate to a desired size to substantially the required circumferential dimension, the temperature of the external surface of the extrudate as the extrudate enters the shaping means being within the range of 50–200° C., non-naturally cooling the extrudate to a predetermined cutting temperature using cooling means at the same time as shaping the extrudate, and cutting the shaping extrudate into filter element lengths, multiples thereof or lengths as otherwise desired.

2. A process of downstream handling of a water-soluble polysaccharide-containing degradable extruded tobacco smoke filtration material to produce tobacco smoke filter elements, the method comprising the steps of continuously conveying the extrudate from an extruder die of an extruder to a cutter, during the transporting of the extrudate removing excess water, if required, providing the extrudate at a temperature suitable for shaping the extrudate, shaping the extrudate by passing the extrudate through a vacuum forming device to expand said extrudate to a desired size to substantially the required circumferential dimension, the temperature of the external surface of the extrudate as the extrudate enters the shaping means being within the range of 50–200° C., non-naturally cooling the extrudate to a predetermined cutting temperature using cooling means, and cutting the shaped extrudate into filter element lengths.

3. A process according to claim 1 or 2, wherein excess moisture is removed from said extrudate by a heating step comprising use of a means selected from the group consisting of hot air blowers, microwave, infra-red, radio frequency heating and a thermal jacket.

4. A process according to claims 1 or 2 wherein said extrudate is subject to haul off from the extruder die of an extruder.

5. A process according to claims 1 or 2 wherein haul off is effected by removing said extrudate from the extruder die of said extruder at a speed which is the same as or greater than the extrusion speed of said extrudate from said extruder.

6. A process according to claims 1 or 2 wherein shaping of the extrudate also includes cooling of said extrudate.

7. A process according to claims 1 or 2 wherein said extruder comprises a vacuum venting system to control the extrudate moisture content exit the die of said extruder.

8. A process according to claims 1 or 2 wherein the temperature of the extrudate at the exit die is within the range of 90–200° C.

9. A process according to claims 1 or 2 wherein the excess moisture is removed by heating the extrudate such that the extrudate temperature is within the range of 50–100° C.

10. A process according to claims 1 or 2 wherein the temperature of the external surface of said extrudate as said extrudate exits the shaping means is as low as 40° C.

11. A process according to claims 1 or 2 wherein the temperature of the external surface of the extrudate is about 30° C.

12. A process according to claims 1 or 2 wherein the predetermined cutting temperature of said extrudate is less than 40° C.

13. A process according to claims 1, or 2 wherein the predetermined cutting temperature of said extrudate is less than 30° C.

14. Downstream handling apparatus in use to provide water-soluble polysaccharide-containing degradable extruded tobacco smoke filtration material, said apparatus comprising an extruder having an extruder die, extrudate conveying means operable to convey extrudate at a speed relative to the extrusion speed of the extrudate as the extrudate exits the extruder die, means operable to heat the extrudate to remove excess moisture from the extrudate, if required shaping means to shape the extrudate, the temperature of the external surface of said extrudate as said extrudate enters said shaping means being within the range of 50–200° C., cooling means to cool the extrudate and a cutter to cut the shaped extrudate into tobacco smoke filter element lengths, multiples thereof or lengths as otherwise desired, wherein said shaping means comprises a device with grooves or one or more orifice(s) which have a reducing radius or diameter along their path in order to shape said extrudate to the required dimension.

15. Downstream handling apparatus in use to provide water-soluble polysaccharide-containing degradable extruded filtration material, said apparatus comprising an extruder having an extruder die, extrudate conveying means operable to travel at a speed relative to the extrusion speed of the extrudate as the extrudate exits the extruder die, means operable to heat the extrudate to remove excess moisture from the extrudate, if required, shaping means to shape the extrudate, the temperature of the external surface of said extrudate as said extrudate enters said shaping means being within the range of 50–200° C., cooling means to cool the extrudate being incorporated in said shaping means and a cutter to cut the shaped extrudate into tobacco smoke filter element lengths, wherein said shaping means comprises a device with grooves or one or more orifice(s) which have a reducing radios or diameter along their path in order to shape the said extrudate to the required dimension.

16. Downstream handling apparatus in use to provide water-soluble polysaccharide-containing degradable extruded filtration material, said apparatus comprising an extruder having an extruder die, extrudate conveying means operable to convey extrudate at a speed relative to the extrusion speed of the extrudate as the extrudate exits the extruder die, means operable, if required, to heat the extrudate to remove excess moisture from the extrudate, a vacuum forming device to shape the extrudate, the temperature of the external surface of said extrudate as said extrudate enters said shaping means being within the range of 200° C., cooling means to cool the extrudate and a cutter to cut the shaped extrudate into tobacco smoke filter element lengths, multiples thereof or lengths, as otherwise stated.

17. Apparatus according to claims 14, 15 or 16 wherein said extrudate conveying means comprises a flexible belt.

18. Apparatus according to claims 17 wherein the flexible belt comprises grooves of the same or smaller dimension as the shaped extrudate, or otherwise dimensioned so as to shape said extrudate.

19. Apparatus according to claims 14, 15 or 16 wherein said extrudate conveying means is a perforated belt.

20. Apparatus according to claims 14, 15 or 16 wherein said extrudate conveying means comprises a series of rollers.

21. Apparatus according to claims 14, 15 or 16 wherein said extrudate conveying means is located downstream of said shaping means.

22. Apparatus according to claims 14, 15 or 16 wherein the means to heat the extrudate to remove excess moisture is selected from one or more of the group consisting of a hot air blower, a microwave heater, an infra-red heater, a radio-frequency heater and a thermal jacket.

23. Apparatus according to claims 14, 15 or 16 wherein said shaping means also comprises cooling means.

24. Apparatus according to claims 14, 15 or 16 wherein said cutter is selected from the group consisting of a rotary cutter, a reciprocating cutter, a cylindrical cutter, a nip cutter, a laser cutter and cutting means as used in conventional cigarette and filter production machinery.

25. Apparatus according to claims 14 or 15 wherein the extruder comprises a vacuum venting system.

26. Apparatus according to claims 14 wherein said cooling means is selected from the group consisting of a cold air blower, a cooling jacket and a cooled shaping die.

* * * * *